US007862666B2

(12) United States Patent
Kimura et al.

(10) Patent No.: US 7,862,666 B2
(45) **Date of Patent: *Jan. 4, 2011**

(54) HIGHLY ANTICORROSIVE HIGH STRENGTH STAINLESS STEEL PIPE FOR LINEPIPE AND METHOD FOR MANUFACTURING SAME

(75) Inventors: Mitsuo Kimura, Chiyoda-ku (JP); Takanori Tamari, Chiyoda-ku (JP); Yoshio Yamazaki, Chiyoda-ku (JP); Ryosuke Mochizuki, Chiyoda-ku (JP)

(73) Assignee: JFE Steel Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/576,885

(22) PCT Filed: Oct. 22, 2004

(86) PCT No.: PCT/JP2004/016075

§ 371 (c)(1), (2), (4) Date: Apr. 24, 2006

(87) PCT Pub. No.: WO2005/042793

PCT Pub. Date: May 12, 2005

(65) Prior Publication Data

US 2007/0074793 A1 Apr. 5, 2007

(30) Foreign Application Priority Data

| | | |
|---|---|---|
| Oct. 31, 2003 | (JP) | 2003-373404 |
| Feb. 16, 2004 | (JP) | 2004-038854 |
| Apr. 13, 2004 | (JP) | 2004-117445 |
| Apr. 30, 2004 | (JP) | 2004-135973 |

(51) Int. Cl.

| | |
|---|---|
| ***C22C 38/00*** | (2006.01) |
| ***C22C 38/18*** | (2006.01) |
| ***C22C 38/22*** | (2006.01) |
| ***C22C 38/24*** | (2006.01) |
| ***C22C 38/26*** | (2006.01) |
| *C21D 9/08* | (2006.01) |

(52) U.S. Cl. ..... 148/325; 148/592; 148/909; 420/61; 420/69; 420/70

(58) Field of Classification Search ..... 148/325, 148/909, 592; 420/61, 69, 70
See application file for complete search history.

(56) References Cited

U.S. PATENT DOCUMENTS 6,379,821 B2 * 4/2002 Kushida et al. ..... 428/685

FOREIGN PATENT DOCUMENTS

| | | | | |
|---|---|---|---|---|
| EP | 0 649 915 | A1 | | 4/1995 |
| EP | 1 179 380 | A1 | | 2/2002 |
| EP | 1 477 574 | A2 | | 11/2004 |
| EP | 1 514 950 | A1 | | 3/2005 |
| JP | 03-75336 | A | | 3/1991 |
| JP | 03 075336 | A | | 3/1991 |
| JP | 08-41599 | A | | 2/1996 |
| JP | 09-228001 | A | | 9/1997 |
| JP | 09-316611 | A | | 12/1997 |
| JP | 11-80881 | A | | 3/1999 |
| JP | 2001140040 | A | * | 5/2001 |
| JP | 2001-179485 | A | | 7/2001 |
| JP | 2001-279392 | A | | 10/2001 |
| JP | 2002004009 | A | * | 1/2002 |
| JP | 2002 060910 | A | | 2/2002 |
| JP | 2004-107773 | A | | 4/2004 |

OTHER PUBLICATIONS

Joseph R. Davis, ASM Handbook, 1990, ASM International, 10th Edition, vol. 1, 852-853.*

Aggen et al., Wrought Stainless Steels-Fabrication Characteristics, ASM Handbook, 1990, ASM International, vol. 1, p. 13-14.*

Davis et al., Structure/Property Relationships in Irons and Steels-Role of Microstructure, Metals Handbook Desk Edition, 1998, ASM International, 2nd Edition, p. 15-22.*

Omura et al., English machine translation of JP 2001-140040A, May 2001.*

* cited by examiner

*Primary Examiner*—Roy King
*Assistant Examiner*—Caitlin Fogarty
(74) *Attorney, Agent, or Firm*—DLA Piper LLP (US)

(57) ABSTRACT

A highly corrosion resistant high strength stainless steel pipe for linepipe, having a composition containing about 0.001 to about 0.015% C, about 0.01 to about 0.5% Si, about 0.1 to about 1.8% Mn, about 0.03% or less P, about 0.005% or less S, about 15 to about 18% Cr, about 0.5% or more and less than about 5.5% Ni, about 0.5 to about 3.5% Mo, about 0.02 to about 0.2% V, about 0.001 to about 0.015% N, and about 0.006% or less O, by mass, so as to satisfy ($Cr+0.65\ Ni+0.6Mo+0.55Cu-20C \geqq 18.5$), ($Cr+Mo+0.3Si-43.5C-0.4Mn-Ni-0.3Cu-9\ N \geqq 11.5$) and ($C+N \leqq 0.025$). Preferably quenching and tempering treatment is applied to the pipe. The composition may further contain about 0.002 to about 0.05% Al, and may further contain one or more of Nb, Ti, Zr, B, and W, and/or Cu and Ca. The microstructure preferably contains martensite, ferrite, and residual $\gamma$.

9 Claims, 3 Drawing Sheets

HIGHLY ANTICORROSIVE HIGH STRENGTH STAINLESS STEEL PIPE FOR LINEPIPE AND METHOD FOR MANUFACTURING SAME

RELATED APPLICATION

This is a §371 of International Application No. PCT/JP2004/016075, with an international filing date of Oct. 22, 2004 (WO 2005/042793 A1, published May 12, 2005), which is based on Japanese Patent Application Nos. 2003-373404, filed Oct. 31, 2003, 2004-038854, filed Feb. 16, 2004, 2004-117445, filed Apr. 13, 2004, 2004-135973, filed Apr. 30, 2004, and 2004-311885, filed Oct. 27, 2004.

TECHNICAL FIELD

The invention relates to a steel pipe for pipelines that transport crude oil or natural gas produced from oil wells or gas wells. Specifically the invention relates to a high strength stainless steel pipe and a method for manufacturing thereof, which stainless steel pipe has excellent corrosion resistance and resistance to sulfide stress cracking, thereby being suitable for linepipes transporting crude oil or natural gas produced from oil wells or gas wells under extremely corrosive environments containing carbon dioxide gas ($CO_2$), chlorine ion ($Cl^-$), and the like. The term "high strength stainless steel pipe" referred to herein signifies the stainless steel pipe having strength of about 413 MPa (about 60 ksi) or higher yield strength.

BACKGROUND

As countermeasures to the rapid increase of crude oil price in recent years and to the depletion of oil resources expected to appear in the near future, development of deep oil fields which did not draw attention and development of highly corrosive sour gas fields and the like which were once abandoned in their development are emphasized over the world. Those kinds of oil fields and gas fields are generally very deep, and have environments of high temperature and highly corrosive, containing $CO_2$, $Cl^-$, and the like. Accordingly, linepipes used for transporting crude oil and gas produced from those kinds of oil fields and gas fields are requested to use steel pipes having high strength and high toughness, and further having excellent corrosion resistance. In addition, development of offshore oil fields has been vigorously progressed, thus the steel pipes in these oil fields are requested also to have excellent weldability in view of reduction in the pipeline laying cost.

Conventional linepipes adopted carbon steels from the point to assure weldability under environments containing $CO_2$ and $Cl^{-1}$, while separately applying an inhibitor for preventing corrosion. Since, however, inhibitors raise problems of insufficient effect at elevated temperatures and of inducing pollution, their use has been reduced in recent years. Some of the pipelines adopt duplex stainless steel pipes. Although the duplex stainless steel pipes have excellent corrosion resistance, they contain large amounts of alloying elements, are inferior in hot-workability to accept only special hot-working methods for their manufacture, and are expensive. Consequently, the use of stainless steel pipes is rather limited at present. With these problems, industries wait for steel pipes for linepipes having excellent weldability and corrosion resistance, at low price.

Responding to the requirement, there are proposed 11% Cr or 12% Cr martensitic stainless steel pipes that improve the weldability for linepipe services, disclosed in, for example, Unexamined Japanese Patent Publication No. 08-41599, Unexamined Japanese Patent Publication No. 09-228001, and Unexamined Japanese Patent Publication No. 09-316611.

The steel pipe disclosed in JP '599 is a martensitic stainless steel pipe for linepipes, having excellent corrosion resistance at welded part by decreasing carbon content to control the increase in the hardness of the welded part. The steel pipe disclosed in JP '001 is a martensitic stainless steel pipe, which increases the corrosion resistance by adjusting the amounts of alloying elements. The steel pipe disclosed in JP '611 is a martensitic stainless steel pipe for linepipes, which satisfies both the weldability and the corrosion resistance.

SUMMARY

Selected aspects of the invention are described below.

(1) A highly corrosion resistant high strength stainless steel pipe for linepipe having a composition containing: 0.001 to 0.015% C, 0.01 to 0.5% Si, 0.1 to 1.8% Mn, 0.03% or less P, 0.005% or less S, 15 to 18% Cr, 0.5% or more and less than 5.5% Ni, 0.5 to 3.5% Mo, 0.02 to 0.2% V, 0.001 to 0.015% N, and 0.006% or less O, by mass, so as to satisfy the formulae (1), (2), and (3), and balance of Fe and impurities, $$Cr+0.65Ni+0.6Mo+0.55Cu-20C \geqq 18.5 \quad (1)$$

$$Cr+Mo+0.3Si-43.5C-0.4Mn-Ni-0.3Cu-9N \geqq 11.5 \quad (2)$$

$$C+N \leqq 0.025 \quad (3)$$

where C, Ni, Mo, Cr, Si, Mn, Cu, and N signify the content of the respective elements.

(2) The high strength stainless steel pipe for linepipe according to (1), wherein the composition further contains 0.002 to 0.05% Al by mass.

(3) The high strength stainless steel pipe for linepipe according to (1) or (2), wherein the content of Ni is 1.5 to 5.0% by mass.

(4) The high strength stainless steel pipe for linepipe according to any of claims 1 to 3, wherein the content of Mo is 1.0 to 3.5% by mass.

(5) The high strength stainless steel pipe for linepipe according to any of (1) to (3), wherein the content of Mo is more than 2% and not more than 3.5% by mass.

(6) The high strength stainless steel pipe for linepipe according to any of (1) to (5), wherein the composition further contains 3.5% or less Cu by mass.

(7) The high strength stainless steel pipe for linepipe according to (6), wherein the content of Cu is 0.5 to 1.14% by mass.

(8) The high strength stainless steel pipe for linepipe according to any of (1) to (7), wherein the composition further contains at least one element selected from the group consisting of 0.2% or less Nb, 0.3% or less Ti, 0.2% or less Zr, 0.01% or less B, and 3.0% or less W, by mass.

(9) The high strength stainless steel pipe for linepipe according to any of (1) to (8), wherein the composition further contains 0.01% or less Ca by mass.

(10) The high strength stainless steel pipe for linepipe according to any of (1) to (9), wherein the composition further contains a microstructure having 40% or less residual austenite phase and 10 to 60% ferrite phase, by volume, with martensite phase as the base phase.

(11) The high strength stainless steel pipe for linepipe according to (10), wherein the ferrite phase is 15 to 50% by volume.

(12) The high strength stainless steel pipe for linepipe according to (10) or (11), wherein the residual austenite phase is 30% or less by volume.

(13) A method for manufacturing highly corrosion resistant high strength stainless steel pipe for linepipe having the steps of: making a steel pipe having a specified size from a steel pipe base material having a composition containing 0.001 to 0.015% C, 0.01 to 0.5% Si, 0.1 to 1.8% Mn, 0.03% or less P, 0.005% or less S, 15 to 18% Cr, 0.5% or more and less than 5.5% Ni, 0.5 to 3.5% Mo, 0.02 to 0.2% V, 0.001 to 0.015% N, and 0.006% or less O, by mass, so as to satisfy the formulae (1), (2), and (3), and balance of Fe and impurities; reheating the steel pipe to 850° C. or higher temperature; cooling the heated steel pipe to 100° C. or lower temperature at a cooling rate of at or higher than air-cooling rate; and applying quenching and tempering treatment to the cooled steel pipe, to heat thereof to 700° C. or lower temperature, $$Cr+0.65Ni+0.6Mo+0.55Cu-20C \geqq 18.5 \quad (1)$$

$$Cr+Mo+0.3Si-43.5C-0.4Mn-Ni-0.3Cu-9N \geqq 11.5 \quad (2)$$

$$C+N \leqq 0.025 \quad (3)$$

where Cr, Ni, Mo, Cu, C, Si, Mn, and N signify the content of the respective elements.

(14) The method for manufacturing high strength stainless steel pipe for linepipe according to (13) having the steps of: heating the steel pipe base material; making a steel pipe from the steel pipe base material by hot-working; cooling the pipe to room temperature at a cooling rate of at or higher then air-cooling rate, thus obtaining a seamless steel pipe having a specified size; and applying the quenching and tempering treatment to the seamless steel pipe.

(15) The method for manufacturing high strength stainless steel pipe for linepipe according to (13) or (14), having the step of applying a tempering treatment to heat the seamless steel pipe to 700° C. or lower temperature instead of the step of quenching and tempering treatment.

(16) The method for manufacturing high strength stainless steel pipe for linepipe according to any of (13) to (15), wherein the steel pipe base material has the composition of any thereof, further containing 0.002 to 0.05% Al by mass.

(17) The method for manufacturing high strength stainless steel pipe for linepipe according to any of (13) to (16), wherein the content of Ni is 1.5 to 5.0% by mass.

(18) The method for manufacturing high strength stainless steel pipe for linepipe according to any of (13) to (17), wherein the content of Mo is 1.0 to 3.5% by mass.

(19) The method for manufacturing high strength stainless steel pipe for linepipe according to any of (13) to (18), wherein the content of Mo is more than 2% and not more than 3.5% by mass.

(20) The method for manufacturing high strength stainless steel pipe for linepipe according to any of (13) to (19), wherein the steel pipe base material has the composition of any thereof, further containing 3.5% or less Cu by mass.

(21) The method for manufacturing high strength stainless steel pipe for linepipe according to (20), wherein the content of Cu is 0.5 to 1.14% by mass.

(22) The method for manufacturing high strength stainless steel pipe for linepipe according to any of (13) to (21), wherein the steel pipe base material has the composition of any thereof, further containing at least one element selected from the group consisting of 0.2% or less Nb, 0.3% or less Ti, 0.2% or less Zr, 3.0% or less W, and 0.01% or less B, by mass.

(23) The method for manufacturing high strength stainless steel pipe for linepipe according to any of (13) to (22), wherein the steel pipe base material has the composition of any thereof, further containing 0.01% or less Ca by mass.

(24) A welded structure fabricated by welding to join together the high strength stainless steel pipes according to any of (1) to (12).

DETAILED DESCRIPTION

The 11% Cr or 12% Cr martensitic stainless steel pipes manufactured by the technologies disclosed in JP '599, JP '001 and JP '611 may generate sulfide stress corrosion cracking under environments having high partial pressure of hydrogen sulfide, and fail to stably attain desired corrosion resistance under environments containing $CO_2$, $Cl^-$, and the like at high temperatures above 150° C.

We provide a high strength stainless steel pipe for linepipe and a method for manufacturing thereof, which stainless steel pipe is inexpensive, shows excellent resistance to $CO_2$ corrosion even under severe corrosive environments containing $CO_2$, $Cl^-$, and the like at high temperatures of 150° C. or more, shows excellent resistance to sulfide stress cracking even under high hydrogen sulfide environments, and has excellent low temperature toughness and excellent weldability.

To accomplish this, we conducted a detailed study of the effects of various variables affecting corrosion under high temperature corrosive environments containing $CO_2$, $Cl^-$, and the like, and affecting the sulfide stress cracking under high hydrogen sulfide environments, using the composition of 12% Cr steel, which is a typical martensitic stainless steel, as the basis. The study revealed that, when the basic composition of 12% Cr martensitic stainless steel significantly increases the Cr content, significantly decreased the C and N contents from the conventional level, contains adequate amounts of Cr, Ni, Mo, or further Cu, and when the steel forms a microstructure of martensite phase as the basis while containing ferrite phase and residual austenite phase, there are assured a high strength resulting in 413 MPa (60 ksi) or higher yield strength, good hot-workability, good corrosion resistance under severe environments, and excellent weldability.

According to the manufacture of seamless martensitic stainless steel pipes in the related art, there was a common understanding that, when the ferrite phase appears to fail to assure the microstructure with single martensite phase, the strength decreases, and the hot-workability deteriorates, which makes the manufacture of steel pipes difficult.

To this point, we further studied the effect of steel components on hot-workability, and found that a significant improvement in the hot-workability is attained and that crack generation during hot-working is prevented by adjusting the steel pipe composition to satisfy the formula (2):

$$Cr+Mo+0.3Si-43.5C-Ni-0.3Cu-9N \geqq 11.5 \quad (2)$$

where Cr, Ni, Mo, Cu, C, Si, Mn, and N signify the content of the respective elements, (% by mass).

Figure 1:
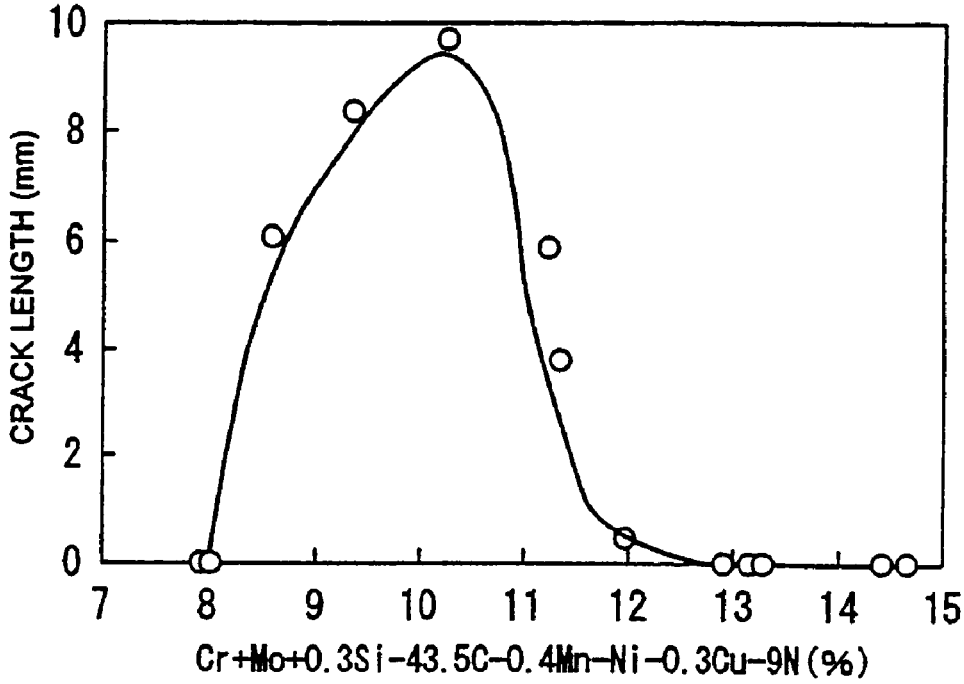
FIG. 1 is a graph showing the effect of steel sheet composition on the length of crack generated during hot-working.

FIG. 1 shows the relation between the values of the left side member of the formula (2) and the length of crack generated at edge face of the seamless 13% Cr stainless steel pipe during hot-working (during tube-making of seamless steel pipe). The figure shows that the crack generation is prevented if the value of left side member of the formula (2) is 8.0 or smaller, or if the value thereof is 11.5 or larger, preferably 12.0 or larger. The value of the left side member of the formula (2) at 8.0 or smaller corresponds to the zone where no ferrite is generated, which zone is for the one, according to a concept of the related art, to improve the hot-workability by preventing the formation of ferrite phase. On the other hand, an increase in the value of the left side member of the formula (2) increases the amount of generating ferrite. The zone where the value of the left side member of the formula (2) is 11.5 or larger is the zone where relatively larger amounts of ferrite are generated. That is, we found that hot-workability is significantly improved by adopting a quite different content from that of the related art, or adjusting the composition so that the value of the left side member of the formula (2) becomes 11.5 or larger, thereby forming a microstructure that relatively large amounts of ferrite are generated in the pipe-making step.

Figure 2:
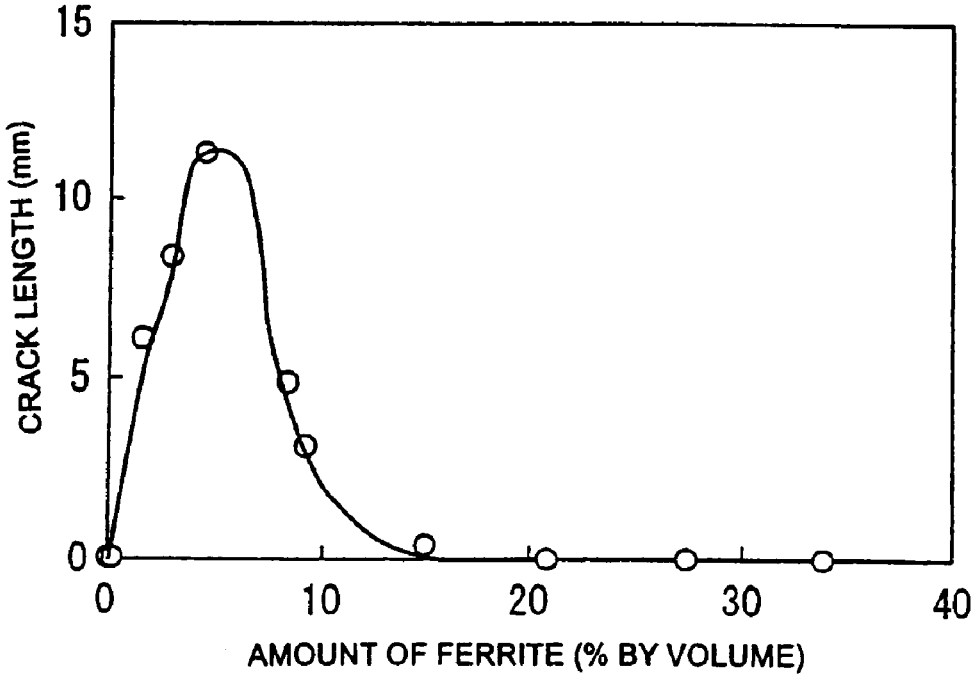
FIG. 2 is a graph showing the relation between the length of crack generated during hot-working and the amount of ferrite.

FIG. 2 shows the length of cracks generated on the edge face of seamless 13% Cr stainless steel pipes during hot-working in relation to the amounts of ferrite. The figure shows that no crack is generated at 0% by volume of ferrite, and that cracks are generated when ferrite is formed, which phenomenon was expected in the related art. When, however, the amounts of generating ferrite increase to form the ferrite phase by 10% or more, or preferably 15% or more, by volume, crack generation can be prevented, which phenomenon is different from the expectations of the related art. That is, hot-workability is improved and crack generation is prevented by adjusting the composition to satisfy the formula (2), thus to form a ferrite and martensite dual-phase microstructure containing appropriate amounts of ferrite phase.

If, however, the components are adjusted to satisfy the formula (2) to form the ferrite and martensite dual-phase microstructure, variations in the allotment of elements occurred during heat treatment may deteriorate the corrosion resistance. With a dual-phase microstructure, the austenite-forming elements such as C, Ni, and Cu diffuse in the martensite phase, while the ferrite-forming elements such as Cr and Mo diffuse in the ferrite phase, thereby inducing dispersion of components between phases in the ultimate product after heat treatment. In the martensite phase, the amount of Cr which is effective in corrosion resistance decreases, while the amount of C which deteriorates the corrosion resistance increases, thereby deteriorating the corrosion resistance in some cases compared with that of homogeneous microstructure.

In this regard, we conducted further studies on the effect of components on the corrosion resistance, and found that the satisfactory corrosion resistance is assured by adjusting the components to satisfy the formula (1) even when the microstructure is a ferrite and martensite dual-phase microstructure:

$$Cr+0.65Ni_0.6Mo+0.55Cr-20C \geqq 18.5 \quad (1)$$

where Cr, Ni, Mo, Cu, and C signify the content of the respective elements.

Figure 3:
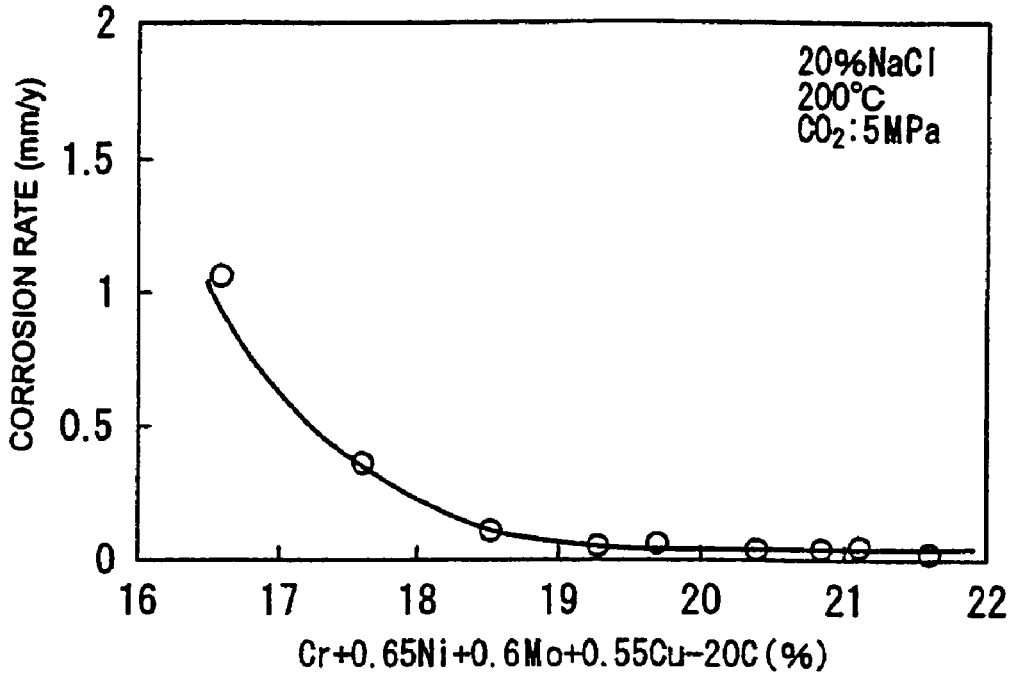
FIG. 3 is a graph showing the effect of steel sheet composition on the corrosion rate under a high temperature environment at 200° C., containing $CO_2$ and $Cl^-$.

FIG. 3 shows the relation between the value of the left side member of the formula (1) and the corrosion rate under environments containing $CO_2$ and $C^-$ at high temperature of 200° C. The figure shows that the sufficient corrosion resistance is assured by adjusting the components to satisfy the formula (1) even with the ferrite and martensite dual-phase microstructure and even under the environments containing $CO_2$ and $Cl^-$ at high temperature of 200° C.

As seen in the formula (1), an increase in the Cr content is effective to improve the corrosion resistance. Since, however, Cr enhances ferrite formation, the related art adds Ni by an amount corresponding to the Cr content to suppress the formation of ferrite. When the Ni content is increased relating to the Cr content, however, the austenite phase is stabilized, which fails to assure the necessary strength as the steel pipe for the linepipe.

We found that the maintained ferrite and martensite dual-phase microstructure, containing an adequate amount of ferrite phase, with increased Cr content, can keep the residual amount of austenite phase to a low level, thereby assuring sufficient strength as the steel pipe for linepipe.

Figure 4:
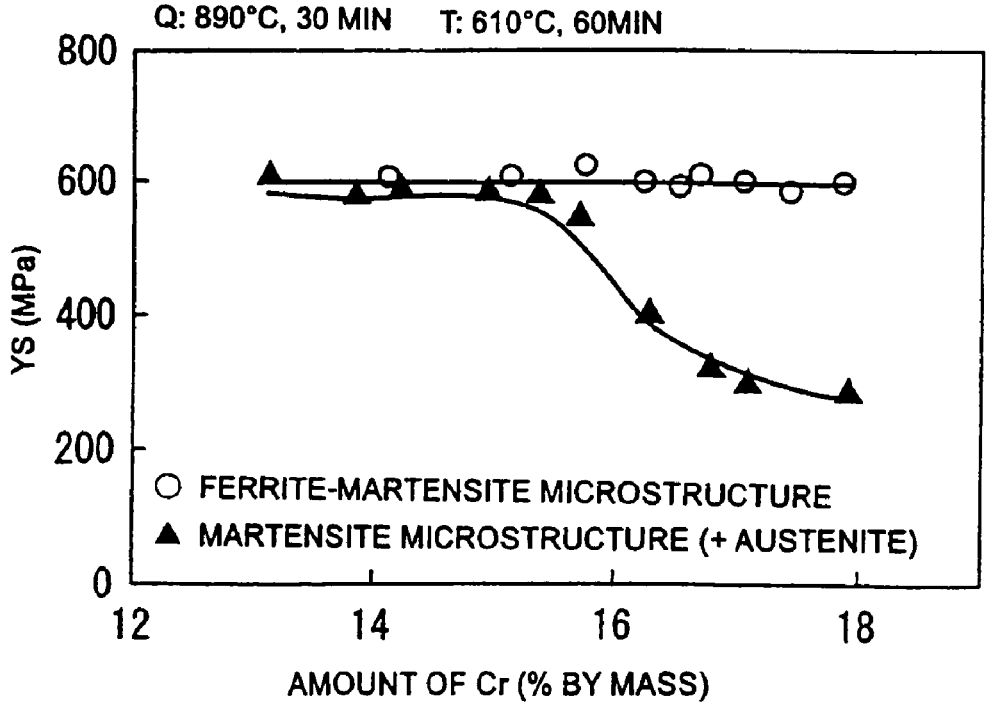
FIG. 4 is a graph showing the relation between the yield strength YS and the Cr content after heat treatment.

FIG. 4 shows the derived relation between the yield strength YS and the Cr content of seamless 13% Cr stainless steel pipes, after heat treatment, having a ferrite and martensite dual-phase microstructure. The figure also shows the relation between YS and Cr content of steel pipes, after heat treatment, having a martensite single phase microstructure or martensite and austenite dual-phase microstructure. The figure reveals the finding that sufficient strength as a steel pipe for linepipe can be assured by keeping the ferrite and martensite dual-phase microstructure containing an adequate amount of ferrite phase with increased Cr content. On the other hand, if the microstructure is that of a martensite single phase or martensite and austenite dual phase, the increase in the Cr content decreases YS.

The steel pipes for linepipes are subjected to girth welding on laying pipeline. Different from the heat treatment of pipe body, the girth welding is conducted by local heating with a small heat input to give a high cooling rate, thus the heat-affected zone is significantly hardened. The hardening of the heat-affected zone results in the generation of weld cracks. We found that weld cracks are prevented and excellent weldability is assured by adjusting the composition of steel pipe to satisfy the formula (3):

$$C+N \leqq 0.025 \quad (3).$$

Figure 5:
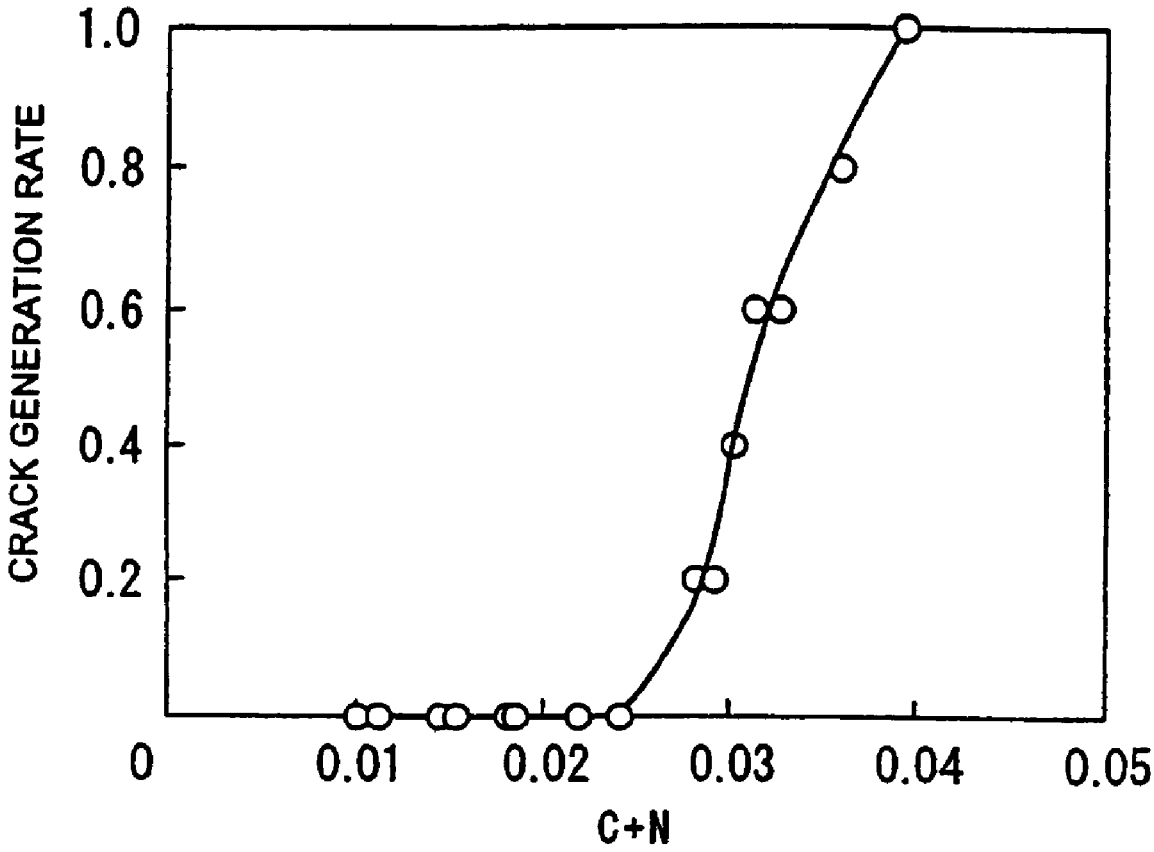
FIG. 5 is a graph showing the effect of the amount of (C+N) on the weld crack generation rate determined in y-slit weld crack test.

FIG. 5 shows the relation between the value of the left side member of the formula (3) and the crack-generation rate determined by a y-slit weld crack test. The figure reveals that weld cracks are prevented by specifying the value of the left side member of the formula (3) to 0.025 or smaller. The crack generation rate was determined by the y-slid weld crack test on each five test pieces, calculating the value of ((the number of crack-generated pieces)/(the number of total tested pieces)).

A description of selected reasons to provide the composition of the high strength stainless steel pipe for linepipe with selected quantities of elements is given below. The % by mass in the composition is hereinafter referred to simply as %.

C: about 0.001 to about 0.015%

Carbon is an important element relating to the strength of martensitic stainless steels, and should contain C by 0.001% or more. If, however, excess amount of C exists, sensitization caused by Ni likely occurs in the tempering step. To prevent the sensitization in the tempering step, the C content is specified to 0.015% as the upper limit. Consequently, the range of the C content is from 0.001 to 0.015%. From the point of corrosion resistance and weldability, the amount C is preferably as small as possible. A preferred range of the C content is from 0.002 to 0.01%.

Si: about 0.01 to about 0.5%

Silicon is an element functioning as a deoxidizer, and is needed in ordinary steel-making process, requiring 0.01% or more. If, however, the C content exceeds 0.5%, the resistance to $CO_2$ corrosion deteriorates, and further the hot-workability deteriorates. Accordingly, the Si content is specified to a range from 0.01 to 0.5%.

Mn: about 0.1 to about 1.8%

Manganese is an element to increase the strength of steel, and 0.1% or more of Si content assures desired strength. If, however, the Mn content exceeds 1.8%, adverse effect on toughness appears. Therefore, the Mn content is specified to a range from 0.1 to 1.8%. A preferred range of the Mn content is from 0.2 to 0.9%.

P: about 0.03% or Less

Phosphorus is an element to deteriorate the resistance to $CO_2$ corrosion, the resistance to $CO_2$ stress corrosion cracking, the resistance to pitting corrosion, and the resistance to sulfide stress corrosion cracking, thus the P content is preferably reduced as far as possible. Extreme reduction in the P content, however, increases the manufacturing cost. Consequently, within a range of industrial availability at relatively low cost and of avoiding the deterioration of the resistance to $CO_2$ corrosion, the resistance to $CO_2$ stress corrosion cracking, the resistance to pitting corrosion, and the resistance to sulfide stress corrosion cracking, the P content is specified to 0.03% or less. A preferred range of the P content is 0.02% or less.

S: about 0.005% or Less

Sulfur is an element to significantly deteriorate the hot-workability during the pipe-manufacturing process, and a smaller S content is more preferable. Since, however, the S content of 0.005% or less allows the ordinary process to manufacture pipes, the upper limit of the S content is specified to 0.005%. A preferred range of the S content is 0.003% or less.

Cr: about 15 to about 18%

Chromium is an element to form a protective film to increase the corrosion resistance, and is effective particularly to improve the resistance to CO2 corrosion and the resistance to CO2 stress corrosion cracking. 15% or more Cr content improves the corrosion resistance under severe environments. On the other hand, if the Cr content exceeds 18%, the hot-workability deteriorates. Therefore, the Cr content is specified to a range from 15 to 18%.

Ni: about 0.5% or More and Less than about 5.5%

Nickel is an element to strengthen the protective film on high Cr steels to improve the corrosion resistance, and functions to increase the strength of low C and high Cr steels. The steel composition thus has 0.5% or more of the Ni content. If, however, the Ni content becomes 5.5% or more, the hot-workability deteriorates and the strength decreases. Accordingly, the Ni content is specified to a range from 0.5% or more and less than 5.5%. A preferred range of the Ni content is from 1.5 to 5.0%.

Mo: about 0.5 to about 3.5%

Molybdenum is an element to increase the resistance to $Cl^-$ pitting corrosion, and the steel composition employs a Mo content of 0.5% or more. If the Mo content is less than 0.5%, the corrosion resistance becomes insufficient under high temperature environments. If the Mo content exceeds 3.5%, the corrosion resistance and the hot-workability deteriorate, and the manufacturing cost increases. Therefore, the Mo content is specified to a range from 0.5 to 3.5%. Preferably the Mo content is from 1.0 to 3.5%, and more preferably more than 2% and not more than 3.5%.

V: about 0.02 to about 0.2%

Vanadium has the effect of increasing the strength and improving the resistance to stress corrosion cracking. These effects become significant at 0.02% or higher V content. If, however, the V content exceeds 0.2%, the toughness deteriorates. Consequently, the V content is specified to a range from 0.02 to 0.2%. A preferred range of the V content is from 0.02 to 0.08%.

N: about 0.001 to about 0.015%

Nitrogen is an element to significantly deteriorate the weldability, and a small amount thereof, as far as possible, is preferred. Since, however, excessive reduction in the N content increases the manufacturing cost, the lower limit of the N content is specified to 0.001%. Since the N content above 0.015% may induce girth weld cracks, 0.015% is specified as the upper limit.

O: about 0.006% or Less

Since O exists as an oxide in the steel to significantly affect various characteristics, reduction in the O content as far as possible is preferred. The O content exceeding 0.006% significantly deteriorates the hot-workability, the resistance to $CO_2$ stress corrosion cracking, the resistance to pitting corrosion, the resistance to sulfide stress corrosion cracking, and the toughness. Consequently, the O content is specified to 0.006% or less.

Adding to the above basic components, the steel can further contain about 0.002 to about 0.05% Al. Aluminum is an element having strong deoxidization performance, and 0.002% or more of Al content is preferred. However, more than 0.05% of Al content adversely affects the toughness. Accordingly, the Al content is preferably specified to a range from 0.002 to 0.05%, and more preferably 0.03% or less. If no Al is added, less than about 0.002% of Al is acceptable as an inevitable impurity. Limiting the Al content to less than about 0.002% gives advantages of significant improvement in the low temperature toughness and resistance to pitting.

About 3.5% or less Cu may be contained in the steel.

Copper is an element to strengthen the protective film, thereby suppressing the invasion of hydrogen into the steel, and increasing the resistance to sulfide stress corrosion cracking. To attain these effects, about 0.5% or more of the Cu content is preferred. However, the Cu content exceeding about 3.5% induces precipitation of CuS at grain-boundary, which deteriorates the hot-workability. Therefore, the Cu content is preferably limited to 3.5% or less, and more preferably in a range from 0.5 to 1.14%.

Adding to the above components, a further one or more of about 0.2% or less Nb, about 0.3% or less Ti, about 0.2% or less Zr, about 0.01% or less B, and about 3.0% or less W may be selectively contained.

Niobium, Ti, Zr, B, and W have the effect of increasing the strength, and, as needed, one or more thereof can be selectively contained.

Niobium is an element to form carbo-nitride, thus increasing the strength and further improving the toughness. To attain these effects, about 0.02% or more Nb content is preferred. However, more than 0.2% of Nb content deteriorates the toughness. Consequently, the Nb content is preferably limited to 0.2% or less.

Titanium Zr, B, and W have effects to increase the strength and improve the resistance to stress corrosion cracking. These effects become significant at about 0.02% or more Ti, about 0.02% or more Zr, about 0.0005% or more B, and about 0.25% or more W. If, however, each of the amounts exceeds about 0.3% Ti, about 0.2% Zr, about 0.01% B, and about 3.0% W, the toughness deteriorates. Therefore, it is preferable to limit to 0.3% or less Ti, 0.2% or less Zr, 0.01% or less B, and 3.0% or less W.

Adding to the above components, a 0.01% Ca may be contained. Calcium is an element to fix S as CaS to spheroidize the sulfide-based inclusions, thereby reducing the lattice strain of matrix peripheral to the inclusions to decrease the hydrogen-trapping capacity of the inclusions. Calcium can be added at need. To attain these effects, 0.0005% or more of the Ca content is preferred. However, more than 0.01% of the Ca content leads to the increase in CaO amount, which deteriorates the resistance to $CO_2$ corrosion and the resistance to pitting corrosion. Therefore, the Ca content is preferably limited to 0.01% or less, and more preferably from 0.0005 to 0.005%.

The balance of the above components is Fe and inevitable impurities.

The components in the above range are added to satisfy the following formulae (1) to (3):

$$Cr+0.65Ni+0.6Mo+0.55Cu-20C \geqq 18.5 \quad (1)$$

$$Cr+Mo+0.3Si-43.5C-0.4Mn-Ni-0.3Cu-9N \geqq 11.5 \quad (2)$$

$$C+N \leqq 0.025 \quad (3)$$

where Cr, Ni, Mo, Cu, C, Si, Mn, and N signify the content of the respective elements.

The element which is given in the formulae and is not existed in the steel is calculated as zero:

$$Cr+0.65Ni+0.6Mo+0.55Cu-20C \geqq 18.5 \quad (1).$$

The left side member of the formula (1) is an index for evaluating the corrosion resistance. If the value of the left side member of the formula (1) is smaller than 18.5, desired corrosion resistance is not attained under severe environments of high temperatures containing $CO_2$ and $Cl^-$, and under high hydrogen sulfide environments. Accordingly, the content of Cr, Ni, Mo, Cu, and C is adjusted within the above range and to satisfy the formula (1). The value of the left side member of the formula (1) is preferably 20.0 or larger:

$$Cr+Mo+0.3Si-43.5C-0.4Mn-Ni-0.3Cu-9N \geqq 11.5 \quad (2).$$

The left side member of the formula (2) is an index for evaluating the hot-workability. Accordingly, the content of Cr, Mo, Si, C, Ni, Mn, Cu, and N is adjusted within the above range and to satisfy the formula (2). If the value of the left side member of the formula (2) is smaller than 11.5, the precipitation of ferrite phase becomes insufficient, and the hot-workability is insufficient, thus the manufacture of seamless steel pipe becomes difficult. The content of P, S, and O is significantly decreased to improve the hot-workability. However, sole reduction of each of P, S, and O cannot assure sufficient hot-workability for making seamless pipe of martensitic stainless steel. To assure necessary and sufficient hot-workability to manufacture seamless steel pipe, it is necessary to significantly decrease the content of P, S, and O, and further to adjust the content of Cr, Mo, Si, C, Ni, Mn, Cu, and N to satisfy the formula (2). In view of improving the hot-workability, the value of the left side member of the formula (2) is preferably 12.0 or larger:

$$C+N \leqq 0.025 \quad (3).$$

The value of the left side member of the formula (3) is an index for evaluating the weldability. If the value of the left side member of the formula (3) exceeds 0.025, weld cracks often appear. Accordingly, the content of C and N is adjusted to satisfy the formula (3).

The high strength stainless steel pipe for linepipe preferably has a microstructure containing, adding to the above components, martensite phase as the base phase, about 40% or less of residual austenite, by volume, or more preferably 30% or less thereof, and about 10 to about 60% of ferrite phase, by volume, or more preferably 15 to 50% thereof. The martensite phase referred to herein also includes tempered martensite phase. By adopting the martensite phase as the base phase, the high strength stainless steel pipe is obtained. The amount of martensite phase is preferably 25% or more by volume. The ferrite phase is a soft microstructure to increase the workability. The amount of ferrite phase is preferably 10% or more by volume. If the ferrite phase exceeds 60% by volume, however, the desired high strength becomes difficult to assure. Therefore, the amount of ferrite phase is preferably in a range from 10 to 60% by volume, and more preferably from 15 to 50% by volume. The residual austenite phase is a microstructure to improve the toughness. If, however, the residual austenite phase exceeds 40% by volume, the desired high strength becomes difficult to assure. Consequently, the amount of residual austenite phase is preferably 40% or less by volume, and more preferably 30% or less by volume.

A preferred method for manufacturing high strength stainless steel pipe for linepipe is described below referring to an example of seamless steel pipe.

Preferably, a molten steel having an above composition is ingoted by a known ingoting method such as converter, electric furnace, and vacuum melting furnace, which ingot is then treated by a known method such as continuous casting process and ingot-making and blooming process to form base material for steel pipe, such as billet. The base material for steel pipe is then heated to undergo hot-working to make pipe using ordinary manufacturing process such as Mannesmann-plug mill and Mannesmann-mandrel mill, thus obtaining a seamless steel pipe having the desired size. After the pipe-making, the seamless steel pipe is preferably cooled to room temperature at a cooling rate of at or higher than the air-cooling rate, preferably at about 0.5° C./s or more as an average rate within a range from about 800° C. to about 500° C.

With a seamless steel pipe such as noted above, the microstructure with the martensite phase as the base phase is attained by cooling the hot-worked seamless steel pipe to room temperature at a cooling rate of at or higher than the air-cooling rate, preferably at 0.5° C./s or more as an average rate within the range from 800° C. to 500° C. Although the seamless steel pipe may be in as cooled state, after hot-working (pipe-making) and after cooling at a cooling rate of at or higher than the air-cooling rate, preferably at 0.5° C./s or more as an average rate within the range from 800° C. to 500° C., a next step preferably further applies quenching and tempering treatment.

A preferable quenching treatment is to reheat the steel to about 850° C. or above, to keep the temperature for about 10 minutes, and then to cool the steel to about 100° C. or below, preferably to room temperature, at a cooling rate of at or higher than the air-cooling rate, preferably at 0.5° C./s or more as an average rate within the range from 800° C. to 500° C. If the quenching heating temperature is below 850° C., the microstructure fails to sufficiently become martensitic microstructure, and the strength tends to decrease. Accordingly, the reheating temperature of the quenching treatment is preferably limited to 850° C. or above. If the cooling rate after the reheating is lower than the air-cooling rate, or lower than 0.5° C./sec as average within the range from 800° C. to 500° C., the microstructure fails to sufficiently become martensitic microstructure. Consequently, the cooling rate after the reheating is preferably at or higher than air-cooling rate, and at or higher than 0.5° C./s as an average within the range from 800° C. to 500° C.

The tempering treatment is preferably given by heating the steel, after quenching, to a temperature not higher than about 700° C. By heating the steel to not higher than 700° C., preferably to 400° C. or above, and then by tempering the steel, the microstructure becomes the one containing tempered martensite phase, residual austenite phase, and ferrite phase, thereby providing a seamless steel pipe having desired high strength, and further having desired high toughness and excellent corrosion resistance. After heating the steel to the above temperature and after holding the temperature for a specified period, it is preferred to cool the steel at a cooling rate of at or higher than the air-cooling rate.

Instead of the above quenching and tempering treatment, a sole tempering treatment is applicable to heat the steel to not higher than 700° C., preferably not lower than 400° C., followed by tempering.

Although the above description is given to seamless steel pipe as an example, this disclosure is not limited to the seamless steel pipe, and it is applicable that a base material for steel pipe, having the composition within the above-described range, is used to manufacture electric resistance welded pipes and UOE steel pipes applying an ordinary process, thus to use them as the steel pipes for linepipes.

Also for the steel pipes such as electric resistance welded pipes and UOE steel pipes, the steel pipe after pipe-making is preferably subjected to the above quenching and tempering treatment. The high strength stainless steel pipes can be welded to join together to fabricate a welded structure. Examples of that kind of welded structure are pipeline and riser. The term "welded structure" referred to herein includes the high strength steel pipes joined together, and the high strength steel pipe joined with other grade of steel pipe.

More details are provided below by referring to the examples.

EXAMPLES

Example 1

Molten steel having the respective compositions given in Table 1 were degassed and cast to the respective 100 kgf ingots as the base materials for steel pipes. The base materials for steel pipes were treated by hot-working using a model seamless rolling mill to make pipes. The pipes were air-cooled to prepare the respective seamless steel pipes (3.3 inch in outer diameter and 0.5 inch in wall thickness).

Thus prepared seamless steel pipes were visually observed to identify the presence/absence of crack on inside and outside surfaces at as air-cooled state, thereby evaluating the hot-workability. The pipe having crack of 5 mm or longer size at front or rear end thereof was defined as "crack exists", and other cases were defined as "no crack exists".

The prepared seamless steel pipes were subjected to quenching and heat-holding under the respective conditions given in Table 2, then were treated by quenching. After that, these pipes were treated by tempering under the condition given in Table 2.

Test pieces for observing microstructure were cut from each of thus prepared seamless steel pipes. The test pieces for observing microstructure were corroded by KOH electrolysis. The microstructure of the corroded surface of each test piece was photographed by SEM (×500) by the counts of 50 or more field of views. An image analyzer was applied to calculate the fraction (% by volume) of the ferrite phase in the microstructure. Regarding the fraction of the residual austenite phase in the microstructure, test pieces for determining characteristics were cut from each of the obtained seamless steel pipes, and X-ray diffractometry was applied to determine the fraction. That is, the X-ray diffractometry determined the integrated diffraction X-ray intensity on (220) plane of γ and (211) plane of α. The determined intensities were converted using the formula:

$$\gamma(\%\text{ by volume})=100/\{(1+(I_\alpha R_\gamma/I_\gamma R_\alpha)\}$$

where $I_\alpha$: Integrated intensity of α

$I_\gamma$: Integrated intensity of γ

$R_\alpha$: Crystallographic theoretical value of α

$R_\gamma$: Crystallographic theoretical value of γ.

The fraction of martensite phase in the microstructure was calculated as balance of these phases.

The API arc-shaped tensile test pieces were cut from the obtained seamless steel pipes. The tensile test determined their tensile characteristics (yield strength YS and tensile strength TS).

The obtained seamless steel pipes were welded with each other at ends thereof using the welding material given in Table 4 to fabricate the welded pipe joint under the condition given in Table 4.

For thus fabricated welded pipe joint, visual observation was given to identify the presence/absence of weld cracks.

Test pieces were cut from the fabricated welded pipe joint. The test pieces were subjected to the welded part toughness test, the welded part corrosion test, the welded part pitting corrosion test, and the welded part sulfide stress corrosion cracking test. The test methods are the following.

(1) Welded Joint Toughness Test

From the fabricated welded pipe joint, V-notch test pieces (5 mm in thickness) were cut in accordance with JIS Z2202, selecting the heat-affected zone as the notch position. Charpy impact test in accordance with JIS Z2242 was given to these test pieces to determine the absorbed energy $vE_{-60}$(J) at −60° C., thereby evaluating the toughness at the welding heat-affected zone.

(2) Welded Joint Corrosion Test

From the fabricated welded pipe joint, corrosion test pieces (3 mm in thickness, 30 mm in width, and 40 mm in length) were cut by machining so as to contain the weld metal, the welding heat-affected zone, and the mother material part. The corrosion test was conducted by immersing the corrosion test piece in an aqueous solution of 20% NaCl (200° C. of liquid temperature and $CO_2$ gas atmosphere under 50 atm) in an autoclave for a period of 2 weeks. After the corrosion test, the test piece was weighed to determine the mass loss during the corrosion test, thereby deriving the corrosion rate.

(3) Welded Joint Pitting Corrosion Test

From the fabricated welded pipe joint, test pieces were cut by machining to contain the welding metal, the welding heat-affected zone, and the mother metal part. For the pitting corrosion test, the test piece was immersed in a 40% $CaCl_2$ solution (70° C.) and held for 24 hours. After the test, the presence/absence of pitting was observed using a magnifier (×10) to give ○ evaluation to no pitting and X evaluation to pitting. The "pitting" evaluation X was given to the case of 0.2 mm or larger pitting diameter, and the "no pitting" evaluation ○ was given to the cases of smaller than 0.2 mm of pitting or of no pitting.

(4) Welded Joint Sulfide Stress Cracking Test

From the fabricated welded pipe joint, test pieces for fixed load type specified in NACE-TM0177 Method A were cut by machining to contain the welding metal, the welding heat-affected zone, and the mother metal part. For the sulfide stress corrosion cracking test, the test piece was immersed in a solution (20% NaCl aqueous solution (pH of 4.0 and $H_2S$ partial pressure of 0.005 MPa)) in an autoclave. The test was conducted applying stress of 90% of the yield stress of the mother material for a period of 720 hours. The evaluation X was given to the test piece with crack, and the evaluation ○ was given to the test piece with no crack. The result is shown in Table 3.

All the inventive examples showed no cracks on the surface of the steel pipe, meaning that they are the steel pipes having excellent hot-workability, and are high strength steel pipes giving 413 MPa or higher yield strength YS. Furthermore, the inventive examples generated no cracks at the welded part, giving excellent weldability, further they showed excellent toughness at welding heat-affected zone, giving 50 J or higher absorbed energy at −60° C., and they gave a low corrosion rate at the welded part and the mother material part, generating no pitting and sulfide stress cracking, showing sufficient resistance to welded joint corrosion under severe corrosive environments containing $CO_2$ at as high as 200° C. and also under high hydrogen sulfide environments.

To the contrary, the comparative examples generated cracks on the surface of test piece to deteriorate the hot-workability or deteriorate the toughness at the welded part, or generated cracks at the welded joint, or increased the corrosion rate at the mother material part or welded joint to deteriorate the corrosion resistance, or generated pitting at the mother material part or welded joint to deteriorate the resistance to pitting corrosion, or generated sulfide stress cracking at the mother material part or welded joint to deteriorate the resistance to sulfide stress cracking.

Example 2

Molten steel having the respective compositions given in Table 5 were degassed and cast to the respective 100 kgf ingots as the base materials for steel pipes. Similar to Example 1, the base materials for steel pipes were treated by hot-working using a model seamless rolling mill to make pipes. The pipes were air-cooled or water-cooled to prepare the respective seamless steel pipes (3.3 inch in outer diameter and 0.5 inch in wall thickness).

Thus prepared seamless steel pipes were visually observed to identify the presence/absence of crack on inside and outside surfaces at as air-cooled state, thereby evaluating the hot-workability. The pipe having crack of 5 mm or longer size at front or rear end thereof was defined as "crack exists", and other cases were defined as "no crack exists".

The prepared seamless steel pipes were subjected to quenching and heat-holding under the respective conditions given in Table 6, then were treated by quenching. After that, these pipes were treated by tempering under the condition given in Table 6. For some of these steel pipes, however, only the tempering was given without applying quenching.

Similar to Example 1, test pieces for observing microstructure and for determining characteristics were cut from each of the obtained seamless steel pipes. Using these test pieces, there were calculated the fraction of ferrite phase (% by volume), the fraction of residual austenite phase (% by volume), and the fraction of martensite phase (% by volume) to the microstructure.

In addition, the API arc-shaped tensile test pieces were cut from the obtained seamless steel pipes. Similar to Example 1, the tensile test determined their tensile characteristics (yield strength YS and tensile strength TS). Furthermore, from the fabricated welded pipe joint, V-notch test pieces (5 mm in thickness) were cut to determine the absorbed energy $vE_{-40}$ (J) at −40° C.

Similar to Example 1, the obtained seamless steel pipes were welded with each other at ends thereof using the welding material given in Table 4 to fabricate the welded pipe joint under the welding condition given in Table 4.

The obtained welded pipe joint was visually observed to identify the presence/absence of weld crack.

Furthermore, test pieces were cut from the fabricated welded pipe joint. These test pieces were subjected to the welded joint toughness test, the welded part corrosion test, and the welded joint sulfide stress cracking test. The test methods are the following.

(1) Welded Joint Toughness Test

From the fabricated welded pipe joint, V-notch test pieces (5 mm in thickness) were cut in accordance with JIS Z2202, selecting the heat-affected zone as the notch position. Charpy impact test in accordance with JIS Z2242 was given to these test pieces to determine the absorbed energy $vE_{-40}$(J) at −40° C., thereby evaluating the toughness at the welding heat-affected zone.

(2) Welded Joint Corrosion Test

From the fabricated welded pipe joint, corrosion test pieces (3 mm in thickness, 30 mm in width, and 40 mm in length) were cut by machining to contain the weld metal, the welding heat-affected zone, and the mother material part. The corrosion test was conducted, similar to Example 1, by immersing the corrosion test piece in an aqueous solution of 20% NaCl (200° C. of liquid temperature and $CO_2$ gas atmosphere under 50 atm) in an autoclave for a period of 2 weeks. After the corrosion test, the test piece was weighed to determine the mass loss during the corrosion test, thereby deriving the corrosion rate. After the test, the presence/absence of pitting on the surface of the corrosion test piece was observed using a magnifier (×10). The pitting evaluation was given to the case of 0.2 mm or larger pitting diameter, and the no pitting evaluation was given to the cases of smaller than 0.2 mm of pitting or of no pitting.

(3) Welded Joint Sulfide Stress Cracking Test

From the fabricated welded pipe joint, test pieces for fixed load type specified in NACE-TM0177 Method A were cut by machining. For the sulfide stress cracking test, similar to Example 1, the test piece was immersed in a solution (20% NaCl aqueous solution (pH of 4.0 and $H_2S$ partial pressure of 0.005 MPa)) in an autoclave. The test was conducted applying stress of 90% of the yield stress of the mother material for a period of 720 hours. The evaluation X was given to the test piece with crack, and the evaluation ○ was given to the test piece with no crack. The result is shown in Table 7.

All the inventive examples showed no cracks on the surface of the steel pipe, meaning that they are the steel pipes having excellent hot-workability, are high strength steel pipes giving 413 MPa or higher yield strength YS, and are high strength steel pipe having high toughness of 50 J or more of absorbed energy at −40° C. Furthermore, the inventive examples generated no cracks at the welded part, giving excellent weldability, further they showed excellent toughness at the welding heat-affected zone, giving 50 J or higher absorbed energy at −40° C., and they gave low corrosion rate at the welded joint and the mother material part, generating no pitting and sulfide stress corrosion cracking, showing sufficient corrosion resistance under severe corrosive environments containing $CO_2$ at as high as 200° C. and also under high hydrogen sulfide environments.

To the contrary, the comparative examples generated cracks on the surface of the test pieces to deteriorate the hot-workability or deteriorate the toughness at the mother material part, or generated weld cracks to deteriorate the weldability, or deteriorated the toughness at welded part, or increased the corrosion rate at the mother material part or welded joint, or generated pitting to deteriorate the corrosion resistance, or generated sulfide stress cracking to deteriorate the resistance to sulfide stress cracking.

INDUSTRIAL APPLICABILITY

Stable and inexpensive manufacture of high strength stainless steel pipe for linepipe is attained, which stainless steel pipe has high strength of higher than 413 MPa (60 ksi) of yield strength, giving sufficient corrosion resistance under severe corrosive environments containing $CO_2$ and $Cl^-$ at high temperatures and also under high hydrogen sulfide environments, and showing excellent low temperature toughness and weldability, thereby providing marked effects on industries. The inventive steels also have an effect of providing welded structures such as pipeline at low cost, giving excellent corrosion resistance and toughness.

TABLE 1

| Steel | Chemical composition (% by mass) | | | | | | | | | | |
|---|---|---|---|---|---|---|---|---|---|---|---|
| No. | C | Si | Mn | P | S | Cr | Ni | Mo | V | N | O |
| A | 0.006 | 0.24 | 0.35 | 0.02 | 0.001 | 16.9 | 3.65 | 1.98 | 0.091 | 0.006 | 0.0029 |
| B | 0.005 | 0.25 | 0.36 | 0.02 | 0.001 | 17.0 | 4.06 | 1.64 | 0.075 | 0.008 | 0.0044 |
| C | 0.009 | 0.23 | 0.37 | 0.02 | 0.001 | 16.8 | 3.49 | 2.40 | 0.046 | 0.011 | 0.0028 |
| D | 0.006 | 0.25 | 0.36 | 0.02 | 0.001 | 17.6 | 3.65 | 2.45 | 0.096 | 0.012 | 0.0030 |
| E | 0.007 | 0.26 | 0.37 | 0.01 | 0.001 | 17.2 | 3.75 | 1.77 | 0.063 | 0.013 | 0.0026 |
| F | 0.012 | 0.25 | 0.36 | 0.01 | 0.001 | 16.9 | 4.56 | 2.12 | 0.046 | 0.008 | 0.0027 |
| G | 0.009 | 0.24 | 0.39 | 0.02 | 0.001 | 16.8 | 4.13 | 1.86 | 0.051 | 0.006 | 0.0035 |
| H | 0.006 | 0.22 | 0.39 | 0.01 | 0.001 | 17.5 | 3.67 | 2.30 | 0.039 | 0.008 | 0.0016 |
| I | 0.008 | 0.25 | 0.38 | 0.01 | 0.001 | 14.7 | 3.76 | 1.63 | 0.041 | 0.008 | 0.0034 |
| J | 0.012 | 0.24 | 0.32 | 0.02 | 0.001 | 16.0 | 5.64 | 1.57 | 0.044 | 0.006 | 0.0036 |
| K | 0.016 | 0.23 | 0.33 | 0.02 | 0.001 | 16.5 | 4.08 | 1.63 | 0.053 | 0.011 | 0..0030 |
| L | 0.010 | 0.23 | 0.33 | 0.010 | 0.001 | 16.1 | 3.67 | 0.44 | 0.049 | 0.008 | 0.0026 |
| M | 0.008 | 0.23 | 0.39 | 0.01 | 0.001 | 16.2 | 4.19 | 2.29 | 0.062 | 0.005 | 0.0021 |
| N | 0.006 | 0.29 | 0.33 | 0.01 | 0.001 | 16.4 | 4.08 | 2.15 | 0.050 | 0.008 | 0.0037 |
| O | 0.012 | 0.26 | 0.30 | 0.002 | 0.001 | 16.5 | 4.27 | 2.34 | 0.043 | 0.011 | 0.0032 |
| P | 0.006 | 0.24 | 0.35 | 0.02 | 0.001 | 15.7 | 4.16 | 3.19 | 0.063 | 0.010 | 0.0035 |

| Steel No. | Chemical composition (% by mass) Cu | Nb, Ti, Zr, B.W | Ca | Al | Formula (1)* | Formula (2)** | Formula (3)*** | Remark |
|---|---|---|---|---|---|---|---|---|
| A | — | — | — | 0.001 | 20.34 | 14.85 | 0.012 | Example |
| B | 0.87 | Nb: 0.046 | — | 0.001 | 21.00 | 13.96 | 0.013 | Example |
| C | 0.91 | — | 0.001 | 0.002 | 20.83 | 14.87 | 0.020 | Example |
| D | 1.28 | W: 1.404 | — | 0.001 | 22.03 | 15.58 | 0.018 | Example |
| E | 0.68 | Ti: 0.003, B: 0.001 | — | 0.002 | 20.93 | 14.52 | 0.020 | Example |
| F | 1.17 | — | — | 0.001 | 21.54 | 13.45 | 0.020 | Example |
| G | 1.26 | Nb: 0.068 | 0.002 | 0.002 | 21.11 | 13.62 | 0.015 | Example |
| H | — | Zr: 0.019 | — | 0.002 | 21.15 | 15.71 | 0.014 | Example |
| I | — | — | — | 0.001 | 17.96 | 12.07 | 0.016 | Comparative Example |
| J | 0.58 | Ti: 0.034 | — | 0.005 | 20.69 | 11.12 | 0.018 | Comparative Example |
| K | 0.96 | Nb: 0.058 | — | 0.007 | 20.34 | 12.90 | 0.027 | Comparative Example |
| L | 0.85 | — | — | 0.004 | 19.04 | 12.09 | 0.018 | Comparative Example |
| M | — | — | — | 0.001 | 20.14 | 13.82 | 0.013 | Example |
| N | 0.75 | — | — | 0.001 | 20.63 | 13.87 | 0.014 | Example |
| O | 1.01 | Ti: 0.071 | — | 0.001 | 21.00 | 13.60 | 0.023 | Example |
| P | — | Nb: 0.025 | 0.001 | 0.001 | 20.26 | 14.41 | 0.016 | Example |

*Left side member of formula (1) = Cr + 0.65Ni + 0.6Mo + 0.55Cu − 20C

**Left side member of formula (2) = Cr + Mo + 0.3Si − 43.5C − 0.4Mn − Ni − 0.3Cu − 9N

***Left side member of formula (3) = C + N

TABLE 2

| Pipe No. | Steel No. | Cooling after hot-rolling | Quenching: Quenching temperature (° C.) | Quenching: Heat-holding time (min) | Quenching: Cooling method | Tempering: Tempering temperature (° C.) |
|---|---|---|---|---|---|---|
| 1 | A | Air-cooling: 0.5° C./s | 890 | 20 | Air-cooling: 0.5° C./s | 600 |
| 2 | B | Air-cooling: 0.5° C./s | 890 | 20 | Air-cooling: 0.5° C./s | 600 |
| 3 | C | Air-cooling: 0.5° C./s | 890 | 20 | Air-cooling: 0.5° C./s | 600 |
| 4 | D | Air-cooling: 0.5° C./s | 930 | 20 | Air-cooling: 0.5° C./s | 610 |
| 5 | E | Air-cooling: 0.5° C./s | 870 | 20 | Water-cooling: 30° C./s | 610 |
| 6 | F | Air-cooling: 0.5° C./s | 870 | 20 | Water-cooling: 30° C./s | 610 |
| 7 | G | Air-cooling: 0.5° C./s | 930 | 20 | Water-cooling: 30° C./s | 600 |
| 8 | H | Air-cooling: 0.5° C./s | 890 | 20 | Air-cooling: 0.5° C./s | 600 |
| 9 | I | Air-cooling: 0.5° C./s | 890 | 20 | Air-cooling: 0.5° C./s | 600 |
| 10 | J | Air-cooling: 0.5° C./s | 890 | 20 | Air-cooling: 0.5° C./s | 600 |
| 11 | K | Air-cooling: 0.5° C./s | 890 | 20 | Air-cooling: 0.5° C./s | 610 |
| 12 | L | Air-cooling: 0.5° C./s | 930 | 20 | Air-cooling: 0.5° C./s | 610 |
| 13 | M | Air-cooling: 0.5° C./s | 890 | 20 | Air-cooling: 0.5° C./s | 610 |
| 14 | N | Air-cooling: 0.5° C./s | 890 | 20 | Air-cooling: 0.5° C./s | 610 |
| 15 | O | Air-cooling: 0.5° C./s | 890 | 20 | Air-cooling: 0.5° C./s | 610 |
| 16 | P | Air-cooling: 0.5° C./s | 890 | 20 | Air-cooling: 0.5° C./s | 610 |

TABLE 3

| Pipe No. | Steel No. | Hot-workability: Presence/absence of crack | Microstructure of mother material*: Kind* | M % by volume | γ % by volume | F % by volume | Strength of mother material: Yield Strength (MPa) | Tensile strength (MPa) | Toughness at welded part $vE_{-60}$ (J) |
|---|---|---|---|---|---|---|---|---|---|
| 1 | A | ○ | M + γ + F | 54.7 | 5.5 | 39.8 | 568 | 672 | 92 |
| 2 | B | ○ | M + γ + F | 54.7 | 12.8 | 32.5 | 524 | 689 | 95 |
| 3 | C | ○ | M + γ + F | 45.3 | 13.4 | 41.3 | 491 | 674 | 108 |
| 4 | D | ○ | M + γ + F | 33.3 | 21.6 | 45.1 | 512 | 671 | 160 |
| 5 | E | ○ | M + γ + F | 48.3 | 12.6 | 39.1 | 535 | 657 | 97 |
| 6 | F | ○ | M + γ + F | 29.4 | 36.5 | 34.1 | 476 | 615 | 188 |
| 7 | G | ○ | M + γ + F | 50.2 | 19.4 | 30.4 | 537 | 663 | 152 |
| 8 | H | ○ | M + γ + F | 29.9 | 11.4 | 58.7 | 538 | 631 | 91 |
| 9 | I | ○ | M + γ + F | 87.6 | 7.2 | 5.2 | 591 | 697 | 68 |
| 10 | J | x | M + γ + F | 78.4 | 15.3 | 6.3 | 569 | 675 | 49 |
| 11 | K | ○ | M + γ + F | 71.6 | 11.7 | 16.7 | 579 | 677 | 48 |
| 12 | L | ○ | M + γ + F | 79.8 | 7.5 | 12.7 | 557 | 671 | 46 |
| 13 | M | ○ | M + γ + F | 48.8 | 16.5 | 39.7 | 527 | 651 | 123 |
| 14 | N | ○ | M + γ + F | 48.1 | 17.1 | 34.8 | 531 | 656 | 117 |
| 15 | O | ○ | M + γ + F | 48.6 | 18.4 | 33.0 | 538 | 622 | 125 |
| 16 | P | ○ | M + γ + F | 46.5 | 16.8 | 36.7 | 515 | 649 | 93 |

| Pipe No. | Steel No. | Weldability Presence/absence of weld crack | Resistance to Pitting corrosion at welded part Presence/absence of pitting | Resistance to sulfide stress corrosion cracking at welded part Presence/absence of sulfide stress corrosion cracking | Corrosion resistance at welded part Corrosion rate (mm/yr) | Remark |
|---|---|---|---|---|---|---|
| 1 | A | ○ | ○ | ○ | 0.10 | Example |
| 2 | B | ○ | ○ | ○ | 0.09 | Example |
| 3 | C | ○ | ○ | ○ | 0.09 | Example |
| 4 | D | ○ | ○ | ○ | 0.07 | Example |
| 5 | E | ○ | ○ | ○ | 0.09 | Example |
| 6 | F | ○ | ○ | ○ | 0.08 | Example |
| 7 | G | ○ | ○ | ○ | 0.08 | Example |
| 8 | H | ○ | ○ | ○ | 0.09 | Example |
| 9 | I | ○ | x | x | 0.29 | Comparative Example |
| 10 | J | ○ | x | ○ | 0.10 | Comparative Example |
| 11 | K | x | x | ○ | 0.10 | Comparative Example |
| 12 | L | ○ | x | x | 0.11 | Comparative Example |
| 13 | M | ○ | ○ | ○ | 0.07 | Example |
| 14 | N | ○ | ○ | ○ | 0.06 | Example |
| 15 | O | ○ | ○ | ○ | 0.05 | Example |
| 16 | P | ○ | ○ | ○ | 0.07 | Example |

*M: martensite, γ: residual austenite, F: ferrite

TABLE 4

| Welding method | Chemical composition of welding material (% by mass) C | Si | Mn | P | S | Cr | Ni | Mo | N | Shield gas | Entering heat |
|---|---|---|---|---|---|---|---|---|---|---|---|
| GMAW | 0.012 | 0.33 | 0.46 | 0.02 | 0.001 | 24.6 | 9.7 | 1.55 | 0.011 | 98% Ar + 2% $CO_2$ | 1.0 to 1.5 Kj/mm |

TABLE 5

| Steel No. | Chemical composition (% by mass) | | | | | | | | | | | | | | | Formula (1)* | Formula (2)** | Formula (3)*** |
|---|---|---|---|---|---|---|---|---|---|---|---|---|---|---|---|---|---|---|
| 2A | 0.005 | 0.25 | 0.31 | 0.02 | 0.001 | 0.01 | 17.2 | 3.06 | 1.30 | 0.055 | 0.008 | 0.0036 | — | — | — | 19.87 | 15.1 | 0.013 |
| 2B | 0.012 | 0.25 | 0.40 | 0.01 | 0.001 | 0.01 | 16.6 | 3.11 | 1.64 | 0.085 | 0.006 | 0.0038 | 1.13 | Nb: 0.049 | — | 19.99 | 14.1 | 0.018 |
| 2C | 0.011 | 0.23 | 0.37 | 0.01 | 0.001 | 0.01 | 15.9 | 3.58 | 2.27 | 0.092 | 0.004 | 0.0035 | 1.41 | — | 0.003 | 20.14 | 13.6 | 0.015 |
| 2D | 0.009 | 0.25 | 0.37 | 0.02 | 0.001 | 0.01 | 17.6 | 4.14 | 1.67 | 0.088 | 0.008 | 0.0037 | 0.64 | W: 1.14 | — | 21.47 | 14.4 | 0.017 |
| 2E | 0.006 | 0.25 | 0.30 | 0.01 | 0.001 | 0.01 | 17.0 | 3.97 | 1.73 | 0.014 | 0.012 | 0.0038 | 0.78 | Ti: 0.027, B: 0.001 | — | 20.93 | 14.1 | 0.018 |
| 2F | 0.006 | 0.25 | 0.35 | 0.01 | 0.001 | 0.01 | 17.1 | 3.92 | 1.97 | 0.055 | 0.006 | 0.0043 | 1.71 | — | — | 21.65 | 14.3 | 0.012 |
| 2G | 0.007 | 0.22 | 0.31 | 0.01 | 0.001 | 0.01 | 17.7 | 3.66 | 2.50 | 0.027 | 0.007 | 0.0027 | 1.62 | Nb: 0.058 | 0.002 | 22.33 | 15.6 | 0.014 |
| 2H | 0.010 | 0.22 | 0.37 | 0.02 | 0.001 | 0.01 | 16.9 | 4.25 | 1.96 | 0.036 | 0.009 | 0.0036 | — | Zr: 0.001 | — | 20.64 | 14.0 | 0.019 |
| 1. I | 0.012 | 0.26 | 0.35 | 0.01 | 0.001 | 0.01 | 14.8 | 3.22 | 1.92 | 0.073 | 0.012 | 0.0038 | — | — | — | 17.81 | 12.8 | 0.024 |
| 2. J | 0.009 | 0.29 | 0.31 | 0.01 | 0.002 | 0.02 | 16.1 | 5.32 | 1.42 | 0.051 | 0.010 | 0.0030 | 0.69 | Ti: 0.024 | — | 20.61 | 11.5 | 0.019 |
| 2K | 0.016 | 0.27 | 0.34 | 0.02 | 0.001 | 0.02 | 16.2 | 3.63 | 1.48 | 0.067 | 0.012 | 0.0028 | 1.12 | Nb: 0.047 | — | 19.74 | 12.9 | 0.028 |
| 2L | 0.011 | 0.25 | 0.39 | 0.02 | 0.001 | 0.01 | 16.9 | 3.27 | 0.44 | 0.019 | 0.011 | 0.0029 | 1.01 | — | — | 19.63 | 13.1 | 0.022 |
| 2M | 0.012 | 0.25 | 0.33 | 0.02 | 0.001 | 0.01 | 16.0 | 4.23 | 2.41 | 0.055 | 0.011 | 0.0032 | — | — | — | 19.96 | 13.5 | 0.023 |
| 2N | 0.008 | 0.22 | 0.35 | 0.01 | 0.001 | 0.01 | 16.4 | 4.09 | 2.36 | 0.062 | 0.009 | 0.0036 | 0.95 | Ti: 0.064 | — | 20.84 | 13.9 | 0.017 |
| 2O | 0.011 | 0.25 | 0.34 | 0.02 | 0.001 | 0.01 | 15.7 | 3.78 | 2.74 | 0.059 | 0.007 | 0.0024 | 1.12 | Nb: 0.051 | — | 20.20 | 13.7 | 0.018 |
| 2P | 0.006 | 0.29 | 0.33 | 0.02 | 0.001 | 0.01 | 16.3 | 4.28 | 2.25 | 0.055 | 0.009 | 0.0028 | — | — | — | 20.31 | 13.9 | 0.015 |

*Left side member of formula (1) = Cr + 0.65Ni + 0.6Mo + 0.55Cu − 20C

**Left side member of formula (2) = Cr + Mo + 0.3Si − 43.5C − 0.4Mn − Ni − 0.3Cu − 9N

***Left side member of formula (3) = C + N

TABLE 6

| Pipe No. | Steel No. | Cooling after hot-rolling | Quenching: Quenching temperature (° C.) | Quenching: Heat-holding time (min) | Quenching: Cooling speed* (° C./s | Tempering Tempering temperature (° C.) |
|---|---|---|---|---|---|---|
| 21 | 2A | Air-cooling: 0.5° C./s* | 890 | 20 | Air-cooling: 0.5° C./s | 600 |
| 22 | 2B | Air-cooling: 0.5° C./s | 890 | 20 | Air-cooling: 0.5° C./s | 600 |
| 23 | 2C | Air-cooling: 0.5° C./s | 890 | 20 | Air-cooling: 0.5° C./s | 600 |
| 24 | 2D | Air-cooling: 0.5° C./s | 890 | 20 | Air-cooling: 0.5° C./s | 600 |
| 25 | 2E | Air-cooling: 0.5° C./s | 890 | 20 | Water-cooling: 30° C./s | 600 |
| 26 | 2F | Air-cooling: 0.5° C./s | 890 | 20 | Water-cooling: 30° C./s | 600 |
| 27 | 2G | Air-cooling: 0.5° C./s | 890 | 20 | Water-cooling: 30° C./s | 600 |
| 28 | 2H | Air-cooling: 0.5° C./s | 890 | 20 | Air-cooling: 0.5° C./s | 600 |
| 29 | 2I | Air-cooling: 0.5° C./s | 890 | 20 | Air-cooling: 0.5° C./s | 600 |
| 30 | 2J | Air-cooling: 0.5° C./s | 890 | 20 | Air-cooling: 0.5° C./s | 600 |
| 31 | 2K | Air-cooling: 0.5° C./s | 890 | 20 | Air-cooling: 0.5° C./s | 600 |
| 32 | 2L | Air-cooling: 0.5° C./s | 890 | 20 | Air-cooling: 0.5° C./s | 600 |
| 33 | 2A | Air-cooling: 0.5° C./s | 900 | 30 | Air-cooling: 0.5° C./s | 600 |
| 34 | 2B | Air-cooling: 0.5° C./s | 930 | 30 | Air-cooling: 0.5° C./s | 600 |
| 35 | 2B | Air-cooling: 0.5° C./s | — | — | — | 600 |
| 36 | 2M | Air-cooling: 0.5° C./s | 890 | 20 | Air-cooling: 0.5° C./s | 600 |
| 37 | 2N | Air-cooling: 0.5° C./s | 890 | 20 | Air-cooling: 0.5° C./s | 600 |
| 38 | 2O | Air-cooling: 0.5° C./s | 890 | 20 | Air-cooling: 0.5° C./s | 600 |
| 39 | 2P | Air-cooling: 0.5° C./s | 890 | 20 | Air-cooling: 0.5° C./s | 600 |

*Average cooling speed between 800 to 500° C.

TABLE 7

| Pipe No. | Steel No. | Microstructure of mother material: Kind* | Martensite % by volume | Residual austenite % by volume | Ferrite % by Volume | Hot-workability: Presence/absence of crack | Strength of mother material: Yield strength (MPa) | Tensile strength (MPa) | Toughness at mother material part $vE_{-40}$ J |
|---|---|---|---|---|---|---|---|---|---|
| 21 | 2A | M, γ, F | 32.4 | 6.2 | 61.4 | ○ | 492 | 620 | 153 |
| 22 | 2B | M, γ, F | 39.2 | 19.9 | 40.9 | ○ | 497 | 640 | 169 |

TABLE 7-continued

| | | | | | | | | | |
|---|---|---|---|---|---|---|---|---|---|
| 23 | 2C | M, γ, F | 29.4 | 36.9 | 33.7 | ○ | 479 | 669 | 192 |
| 24 | 2D | M, γ, F | 42.3 | 14.1 | 43.6 | ○ | 529 | 598 | 184 |
| 25 | 2E | M, γ, F | 54.5 | 4.9 | 40.6 | ○ | 569 | 624 | 194 |
| 26 | 2F | M, γ, F | 31.5 | 27.1 | 41.4 | ○ | 483 | 625 | 232 |
| 27 | 2G | M, γ, F | 28.6 | 4.1 | 67.3 | ○ | 534 | 644 | 173 |
| 28 | 2H | M, γ, F | 52.3 | 15.3 | 37.4 | ○ | 520 | 652 | 226 |
| 29 | a. I | M, γ, F | 59.8 | 23.8 | 16.4 | ○ | 493 | 612 | 179 |
| 30 | 2J | M, γ, F | 58.5 | 36.8 | 4.7 | x | 467 | 591 | 194 |
| 31 | 2K | M, γ, F | 65.2 | 16.6 | 18.2 | ○ | 531 | 638 | 88 |
| 32 | 2L | M, γ, F | 60.9 | 12.4 | 26.7 | ○ | 522 | 641 | 172 |
| 33 | 2A | M, γ, F | 33.8 | 5.7 | 60.5 | — | 501 | 634 | 177 |
| 34 | 2B | M, γ, F | 42.6 | 18.0 | 39.4 | — | 535 | 637 | 187 |
| 35 | 2B | M, γ, F | 52.3 | 7.6 | 40.1 | ○ | 573 | 674 | 178 |
| 36 | 2M | M, γ, F | 47.6 | 18.6 | 33.8 | ○ | 564 | 679 | 164 |
| 37 | 2N | M, γ, F | 46.9 | 20.4 | 32.7 | ○ | 560 | 674 | 159 |
| 38 | 2O | M, γ, F | 48.2 | 18.2 | 33.6 | ○ | 579 | 684 | 160 |
| 39 | 2P | M, γ, F | 48.6 | 18.5 | 32.9 | ○ | 561 | 666 | 155 |

| Pipe No. | Steel No. | Weldability Presence/ Absence of weld crack | Toughness at welded part $vE_{-40}$ J | Resistance to sulfide stress corrosion cracking at welded part Presence/absence of sulfide stress corrosion cracking | Corrosion resistance at welded part Corrosion rate mm/yr | Corrosion resistance at welded part Presence/ absence of pitting | Remark |
|---|---|---|---|---|---|---|---|
| 21 | 2A | ○ | 107 | ○ | 0.10 | ○ | Example |
| 22 | 2B | ○ | 121 | ○ | 0.10 | ○ | Example |
| 23 | 2C | ○ | 135 | ○ | 0.09 | ○ | Example |
| 24 | 2D | ○ | 147 | ○ | 0.06 | ○ | Example |
| 25 | 2E | ○ | 161 | ○ | 0.09 | ○ | Example |
| 26 | 2F | ○ | 137 | ○ | 0.06 | ○ | Example |
| 27 | 2G | ○ | 118 | ○ | 0.05 | ○ | Example |
| 28 | 2H | ○ | 179 | ○ | 0.08 | ○ | Example |
| 29 | a. I | ○ | 135 | x | 0.31 | ○ | Comparative Example |
| 30 | 2J | ○ | 163 | ○ | 0.09 | ○ | Comparative Example |
| 31 | 2K | x | 52 | ○ | 0.10 | ○ | Comparative Example |
| 32 | 2L | ○ | 102 | x | 0.11 | x | Comparative Example |
| 33 | 2A | ○ | 111 | ○ | 0.10 | ○ | Example |
| 34 | 2B | ○ | 126 | ○ | 0.10 | ○ | Example |
| 35 | 2B | ○ | 109 | ○ | 0.10 | ○ | Example |
| 36 | 2M | ○ | 129 | ○ | 0.08 | ○ | Example |
| 37 | 2N | ○ | 112 | ○ | 0.07 | ○ | Example |
| 38 | 2O | ○ | 131 | ○ | 0.08 | ○ | Example |
| 39 | 2P | ○ | 123 | ○ | 0.08 | ○ | Example |

*M: martensite, F: ferrite, γ: residual austenite

The invention claimed is:

1. A highly corrosion resistant high strength stainless seamless steel pipe for linepipe having a composition comprising: 0.001 to 0.015% C, 0.01 to 0.5% Si, 0.1 to 1.8% Mn, 0.03% or less P, 0.005% or less S, 15.7 to 18% Cr, 0.5% or more and less than 5.5% Ni, 0.5 to 3.5% Mo, 0.02 to 0.2% V, 0.001 to 0.015% N, and 0.006% or less O, by mass, to satisfy the formulae (1), (2), and (3), and optionally further comprising by mass:

0.002 to 0.05% Al, 3.5% or less Cu, at least one element selected from the group consisting of 0.2% or less Nb, 0.3% or less Ti, 0.2% or less Zr, 0.01% or less B, and 3.0% or less W; and/or 0.01% or less Ca;

and balance of Fe and impurities:

$$Cr+0.65Ni+0.6Mo+0.55Cu-20C \geqq 18.5 \quad (1)$$

$$Cr+Mo+0.3Si-43.5C-0.4Mn-Ni-0.3Cu-9N \geqq 11.5 \quad (2)$$

$$C+N \geqq 0.025 \quad (3)$$

where C, Ni, Mo, Cr, Si, Mn, Cu, and N signify the content of the respective elements, and a microstructure comprising a residual austenite phase that is present in an amount of 4.1% to about 40%, and about 10 to about 60% ferrite and about 25% or more tempered martensite by volume, in a ferrite and martensite dual-phase as a base phase.

2. The high strength stainless seamless steel pipe according to claim 1, wherein the content of Ni is about 1.5 to about 5.0% by mass.

3. The high strength stainless seamless steel pipe according to claim 1, wherein the content of Mo is about 1.0 to about 3.5% by mass.

4. The high strength stainless seamless steel pipe according to claim 1, wherein the content of Mo is more than about 2% and not more than about 3.5% by mass.

5. The high strength stainless seamless steel pipe according to claim 1, wherein the content of Cu is about 0.5 to about 1.14% by mass.

6. The high strength stainless seamless steel pipe according to claim 1, wherein the ferrite phase is about 15 to about 50% by volume.

7. The high strength stainless seamless steel pipe according to claim 1, wherein the residual austenite phase is about 30% or less by volume.

8. A welded structure fabricated by welding to join together the high strength stainless seamless steel pipes according to claim 1.

9. The high strength stainless seamless steel pipe according to claim 1, having a yield strength of 413 to 579 MPa.

* * * * *

UNITED STATES PATENT AND TRADEMARK OFFICE

CERTIFICATE OF CORRECTION

PATENT NO. : 7,862,666 B2
APPLICATION NO. : 10/576885
DATED : January 4, 2011
INVENTOR(S) : Kimura et al.

It is certified that error appears in the above-identified patent and that said Letters Patent is hereby corrected as shown below:

In Column 21

At claim 1, at line 67, please change "C+N ≥ 0.025" to --C+N ≤ 0.025--.

Signed and Sealed this
Seventeenth Day of May, 2011

David J. Kappos

David J. Kappos
*Director of the United States Patent and Trademark Office*